US005245846A

United States Patent [19]

James

[11] Patent Number: 5,245,846

[45] Date of Patent: * Sep. 21, 1993

[54] LOCKING MECHANISM FOR LIGHTWEIGHT SECURITY DOORS

[76] Inventor: C. Thomas James, 460 N. 880 East, Springville, Utah 84663

[ * ] Notice: The portion of the term of this patent subsequent to Nov. 26, 2008 has been disclaimed.

[21] Appl. No.: 816,194

[22] Filed: Jan. 2, 1992

[51] Int. Cl.[5] ..... E05B 63/14; E05C 9/12

[52] U.S. Cl. ..... 70/118; 109/59 R; 292/39

[58] Field of Search ..... 70/1.5, 118–120; 109/59 R, 63, 63.5, 68; 292/36, 39, 160, 51, 142, 279, 280, 33

[56] References Cited

U.S. PATENT DOCUMENTS

| | | | |
|---|---|---|---|
| 554,126 | 2/1896 | Hulse et al. | 70/119 |
| 1,545,962 | 7/1925 | Klein | 70/118 |
| 1,876,193 | 9/1932 | Wolters | 70/118 |
| 2,375,196 | 5/1945 | Cederwall | 70/118 |
| 4,184,349 | 1/1980 | Zaks | 292/39 X |
| 4,288,944 | 9/1981 | Donovan | 292/39 X |
| 4,432,573 | 2/1984 | Goldman | 70/118 X |
| 4,470,277 | 9/1984 | Uyeda | 70/118 |
| 4,520,736 | 6/1985 | Crosby et al. | 109/63.5 X |
| 4,534,192 | 8/1985 | Harshbarger et al. | 70/118 |
| 4,679,415 | 7/1987 | Spratt | 292/39 X |
| 5,067,755 | 11/1991 | James | 109/59 R X |
| 5,094,483 | 3/1992 | James | 292/39 |

*Primary Examiner*—Peter M. Cuomo
*Assistant Examiner*—Suzanne L. Dino
*Attorney, Agent, or Firm*—Trask, Britt & Rossa

[57] ABSTRACT

A locking mechanism for use with lightweight security doors includes a first gear and a mechanically associated second gear. A lock disposed proximate the second gear is adapted to form a releasable locking engagement with the second gear. The first gear is mechanically associated with a locking assembly which intercooperates with the door frame of the security door to produce a locking engagement therewith. The locking assembly is actuated by the rotation of the first gear. A rotation of the first gear causes a corresponding rotation of the second gear and vice versa. The second gear is mounted to be manually displaceable whereby the second gear can be displaced out of engagement with the lock and thereby become rotatable notwithstanding that the lock has been set in its locked condition. The locking mechanism provides a construction which may be unlocked by an individual positioned proximate the interior surface of the security door especially someone who has been inadvertently locked in a vault or security room fitted with a security door.

10 Claims, 6 Drawing Sheets

LOCKING MECHANISM FOR LIGHTWEIGHT SECURITY DOORS

BACKGROUND OF THE INVENTION

1. Field

This invention relates to security doors and locking mechanisms adapted for use with such doors. More particularly, this invention is directed to an interior release apparatus for use with the locking mechanism of a lightweight security door.

2. Statement of the Art

Security doors adapted for use with vaults and safes have been known for many years. Such doors are typically fitted with a mechanical structure which permits the door to be selectively locked in a closed and secure condition. Many security doors are specifically constructed for use with large vaults. While many lightweight safes define storage areas which are relatively small in dimension, vaults are often sufficiently large that the user may actually step through the vault door opening and into the storage area of the vault. The capability of the user to actually enter the interior of the vault provides many advantages as far as optimizing the use of the vault.

While many benefits are obtained by structuring a vault to permit the user's entry into the interior of the vault, one complication of importance results from this structuring, namely the possibility of the door being inadvertently closed while the user is still inside of the vault. Understandably given the relatively small interior defined by most vaults and further recognizing that most vaults are constructed to be air-tight as a security measure it follows that the inadvertent locking of a user inside a vault may have serious if not life threatening consequences to the user. Accordingly, there exists a need for apparatus adapted to permit a user to operate the locking mechanism of a vault security door from the interior face of the security door and open the security door from a location within the vault itself.

SUMMARY OF THE INVENTION

The instant invention provides a locking mechanism for a lightweight security door which is operable by a user located proximate the interior face of the security door. Being so operable, the locking mechanism is adapted to be actuated by a user located within the interior of the vault.

The locking mechanism includes a first gear which is mounted to mechanically engage a locking means positioned on the interior face of the security door. The locking means is adapted to intercooperate with the door frame of the security door to form a releasable locking union of the security door with the door frame. A second gear is mechanically associated with the first gear such that a rotation of the first gear causes a corresponding rotation of the second gear and vice versa. The second gear is adapted to be rotated manually by a user positioned proximate the interior surface of the security door. The second gear is mechanically associated with a lock assembly. The lock assembly is adapted, in a first condition, to physically engage the second gear and selectively lock that second gear in place. In locking the second gear in place, the lock assembly also locks the first gear in place due to the mechanical association of the two gears. Furthermore, with the first gear being locked in place, the locking means is also locked in place.

The second gear is mounted to be displaceable relative to the lock assembly whereby, in a second condition, the second gear may be displaced to a location where it no longer physically engages the lock assembly. In this second condition, the second gear is free to rotate about its axis of rotation. Furthermore, the second gear may also, in its second condition, cause the first gear to rotate thereby causing the locking means to disengage from the door frame of the security door. In some embodiments the invention provides a structure which facilitates the manual displacement of the second gear out of engagement with the lock assembly. Once the second gear has been disengaged physically from the locked lock assembly the first gear may be rotated manually by a driver gear to effect a disengagement of the locking means from the door frame of the security door. Once the locking means has been disengaged from the door frame, the user may open the door by pushing the door outwards.

A resistance means is mounted to engage the second gear and urge that second gear into engagement against the lock assembly. The resistance means is configured such that it may be overcome by the application of a manual force.

In some embodiments of the invention a driver gear is mechanically associated with the first gear. This driver gear is adapted to be manually operated by a user positioned proximate the interior face of the security door. The driver gear is arranged to permit the user to manually rotate the first gear sufficiently to effect a disengagement of the locking means from the door frame. In these embodiments, the user may first disengage the second gear from the locking assembly by overcoming the resistance means. Thereafter the second gear is retained out of locking engagement with the locking assembly while the driver gear is operated to rotate the first gear and thereby disengage the locking means from the door frame of the vault.

DETAILED DESCRIPTION OF THE ILLUSTRATED EMBODIMENT

Figure 1:
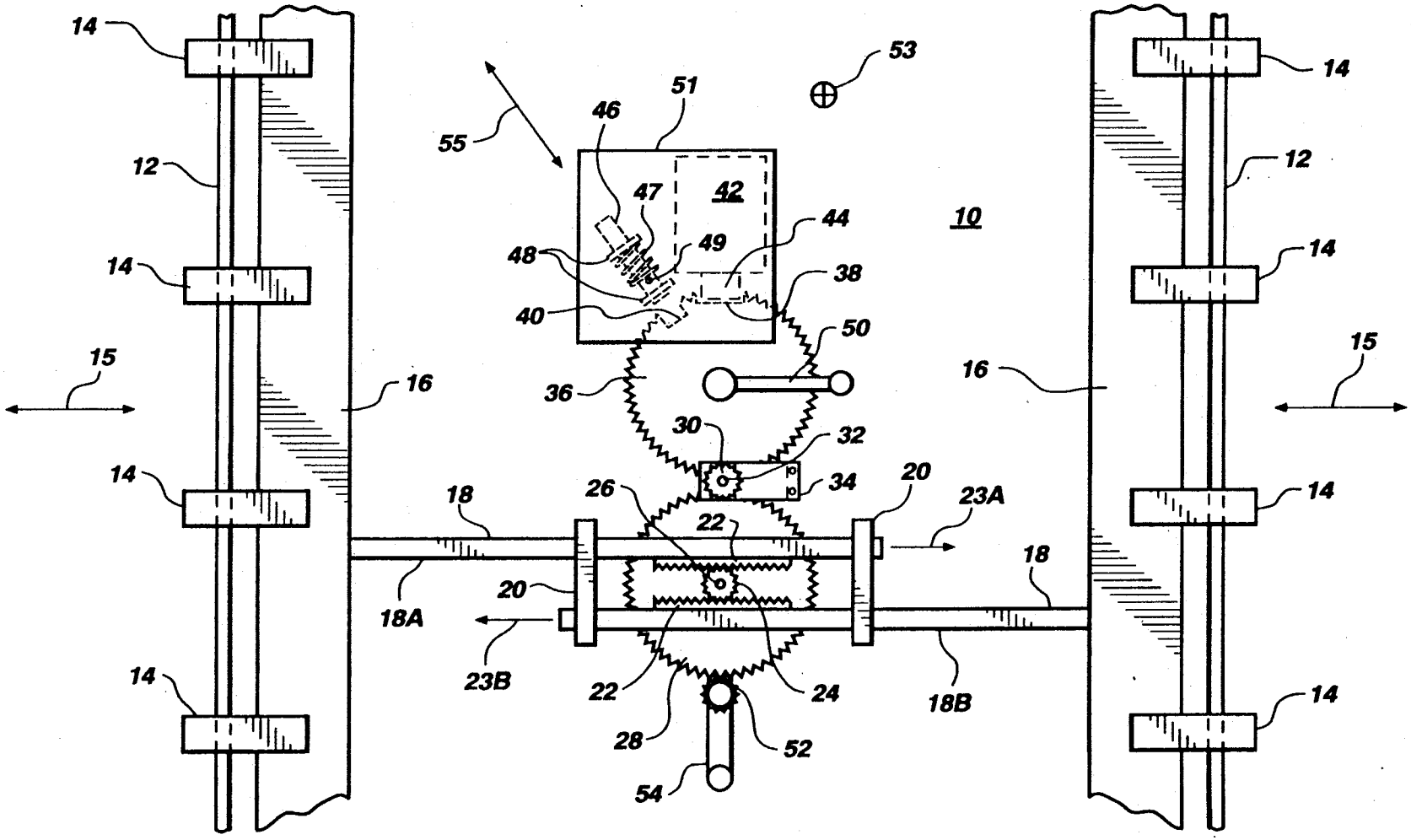
FIG. 1 is a front sectional view of the locking mechanism of the instant invention installed on the interior surface of a vault door.
Figure 2:
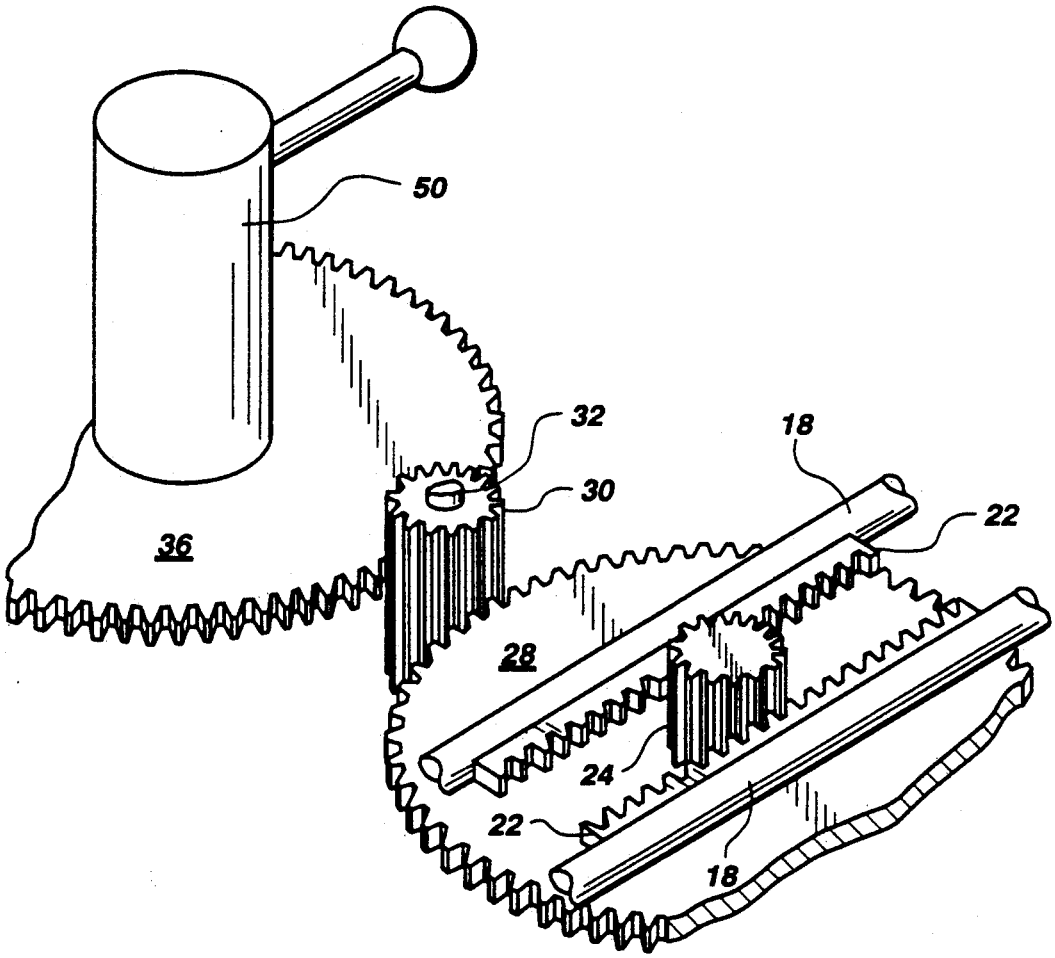
FIG. 2 is a partial sectional view of the first and second gears of the locking mechanism.
Figure 8:
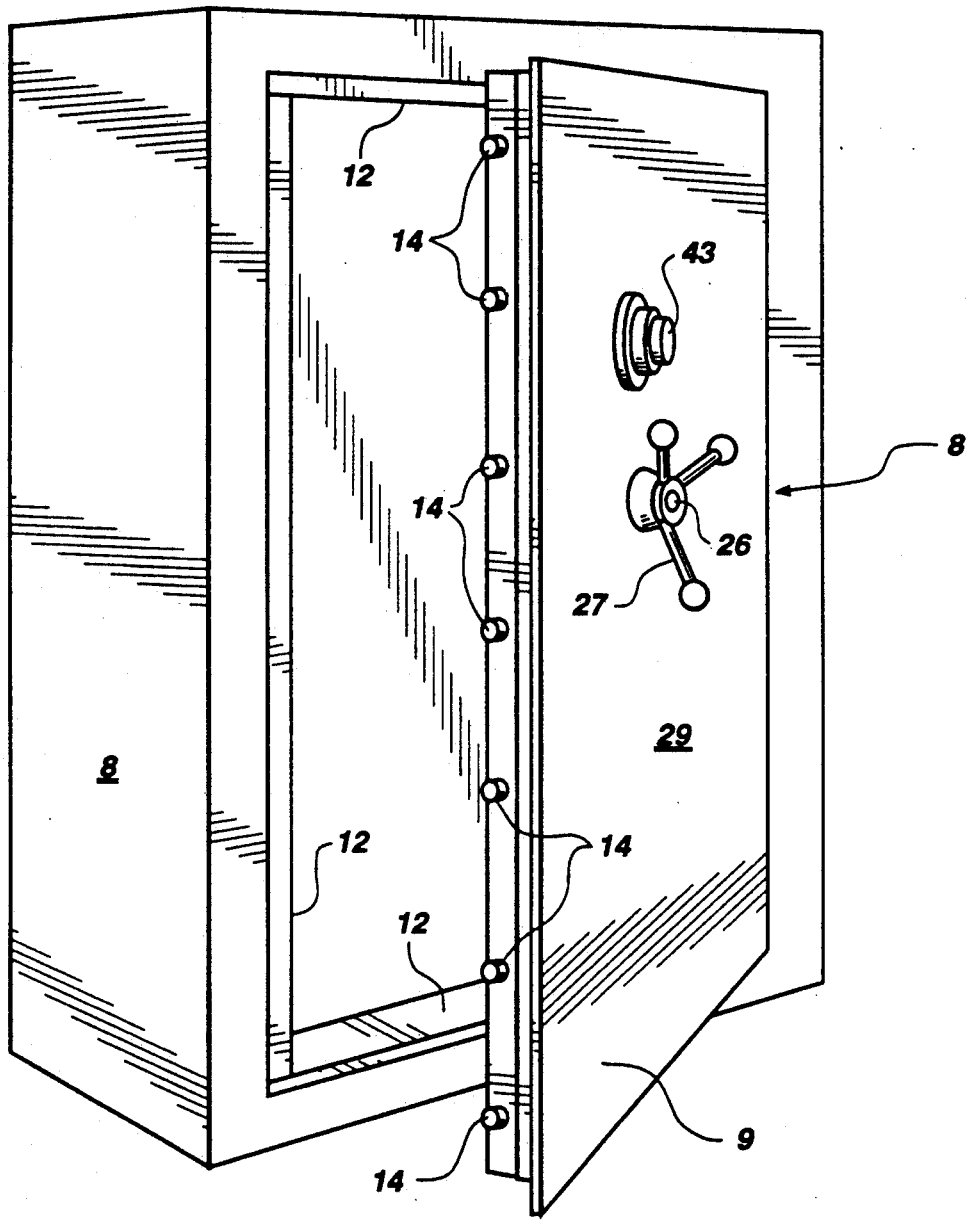
FIG. 8 is a perspective view of a vault fitted with the locking mechanism. It being understood that the instant invention is equally applicable to security rooms as well as any other types of structures which require a security door.

The locking mechanism 7 shown in FIG. 1 is adapted to be mounted on the planar interior surface 10 of a security door 9 of a security vault 8 or a security room (see FIG. 8). The door 9 is positioned within a door frame 12. The door frame forms a rectangularly configured perimeter in which the door is positioned in its closed condition.

The locking mechanism includes a plurality of studs 14 which are adapted to be slidably displaced in the directions indicated by arrow 15. The studs 14 are arranged in a vertical array and are adapted to be extended behind the door frame 12. The studs 14 abut against the door frame 12 of the vault to form a locking engagement with the door frame. Each of the studs 14 is fixedly mounted to a support 16. As shown in FIG. 1 two supports 16 are arranged in a parallel orientation one with respect to the other. The supports 16 are adapted to be displaced in the directions indicated by arrows 15 similarly to the studs 14 attached thereto. Each of the supports 16 is fitted with a respective elongate shaft 18. The shafts 18 are slidably journaled through a pair of support brackets 20. The support brackets 20 are fixedly secured to the interior face 10 of the security door. The support brackets 20 provide a guide assembly for the assemblage made up of the studs 14, the supports 16 and the shafts 18.

As shown in FIG. 1 the support brackets 20 are positioned spacedly apart from one another and parallel to one another. Each of the shafts 18 is fitted with a respective rack gear 22. The rack gears 22 are positioned parallel to one another and spaced apart from each other. A toothed pinion gear 24 is positioned between the opposing rack gears 22. The teeth of the pinion gear are meshed and intercooperated with the teeth of each of the two rack gears 22. A clockwise rotation of the pinion gear 24 causes the shaft 18*a* to be displaced in the direction indicated by arrow 23*a* and the shaft 18*b* to be displaced in the direction indicated by arrow 23*b*. It follows that a clockwise rotation of the pinion gear 24 causes the studs 14 to be drawn toward the pinion gear and out of locking engagement with the door frame 12 of the vault 8.

The pinion gear 24 is fixedly mounted on an axle 26. The axle 26 in turn is journaled through the security door 9. The opposing end of the axle 26 is fitted with a handle 27 which may be grasped and rotated by a user positioned proximate the exterior face 29 of the security door 9.

A toothed gear 28 is also fixed mounted on the axle 26. As shown the gears 24 and 28 are coaxially mounted and may be fixedly secured to each other. An axle 30 is fixedly mounted to the interior face 10 of the security door 9 proximate the perimeter of the toothed gear 28. As shown in FIG. 1 a pinion gear 32 is journaled onto axle 30 to be rotatable thereabout. The teeth of the pinion gear 32 are meshed with the teeth of the gear 28 whereby a rotation of either gear causes a corresponding rotation of the other gear in a direction opposite to the direction of rotation of the first gear. The pinion gear 32 is retained in place by a cover plate 34 which is supported above the surface 10 of the security door 9 by a plurality of supports.

Figure 3:
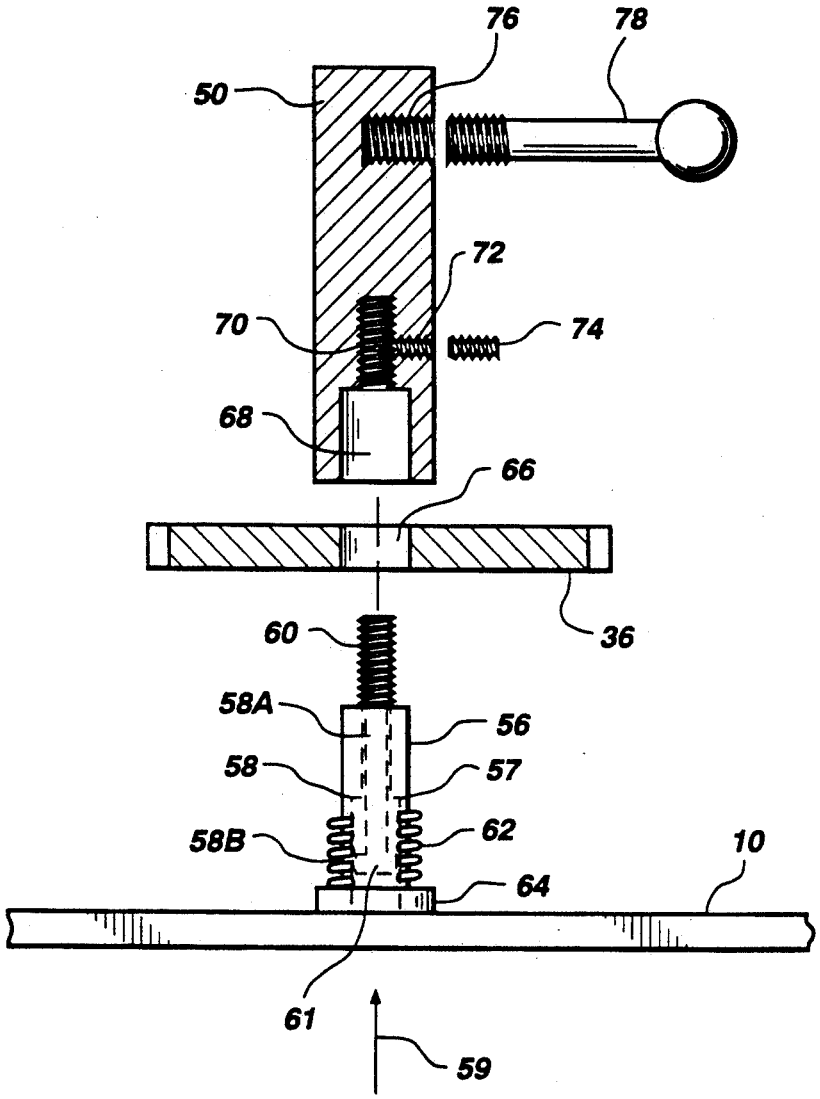
FIG. 3 is an exploded view of the second gear in association with the apparatus adapted for displacing that gear.

A toothed gear 36 is rotatably mounted on the surface 10 of the security door 9 by means of an idler shaft 56 as shown to advantage in FIG. 3. The idler shaft is a cylindrical member which is secured to the surface 10 to extend outwardly generally orthogonal to the plane of surface 10. The interior of the idler shaft 56 defines a channel 58 which extends through the complete height of the shaft. The channel 58 is formed of two sections which are dimensionally distinct from one another. The first section 58*a* is a cylindrical shaped channel which is oriented such that its longitudinal axis is collinear with the longitudinal axis of the idler shaft 56. The second section 58*b* of the channel 58 is also cylindrical in configuration and is likewise oriented such that its longitudinal axis is collinear with the longitudinal axis of the shaft 56. The intersection of the two channels 58*a* and 58*b* forms a shelf 57.

Positioned slidably within the channel 58 is a male threaded bolt 60. The threaded portion of the bolt extends through the section 58*a* of the channel 58 and extends outwardly from the top of the idler shaft 56. Understandably the external diameter of the threaded portion of the bolt 60 is dimensionally smaller than the diameter of the channel section 58*a*. The bolt 60 includes a head 61 which has a diameter which is dimensionally larger than the diameter of the threaded portion of the bolt 60. Furthermore the diameter of the head 61 is dimensionally larger than the diameter of the channel section 58*a*. The diameter of the head 61 of the bolt 60 is dimensionally smaller than the diameter of the channel section 58*b*. The head 61 of the bolt 60 is positioned in channel section 58*b*. It follows that as the bolt 60 is displaced in the direction indicated by arrow 59 eventually the head 61 of the bolt 60 abuts and engages the shelf 57 which is formed by the intersection of the two sections of channel 58. The shelf 57 prevents any further displacement of the bolt 60 in the direction indicated by arrow 59. The bolt 60 is able to freely slide through the channel 58 without obstruction until either the head 61 abuts against the surface 10 of the security door or until the head 61 abuts against the shelf 57.

Positioned about the exterior surface of the idler shaft 56 is a coil spring 62. The spring constant of the spring 62 is chosen so as to permit the user to compress the spring 62 with manual pressure. The toothed gear 36 is positioned on the idler shaft 56 such that the spring 62 is sandwiched between the gear 36 and the base 64 of the idler shaft 56.

Figure 4:
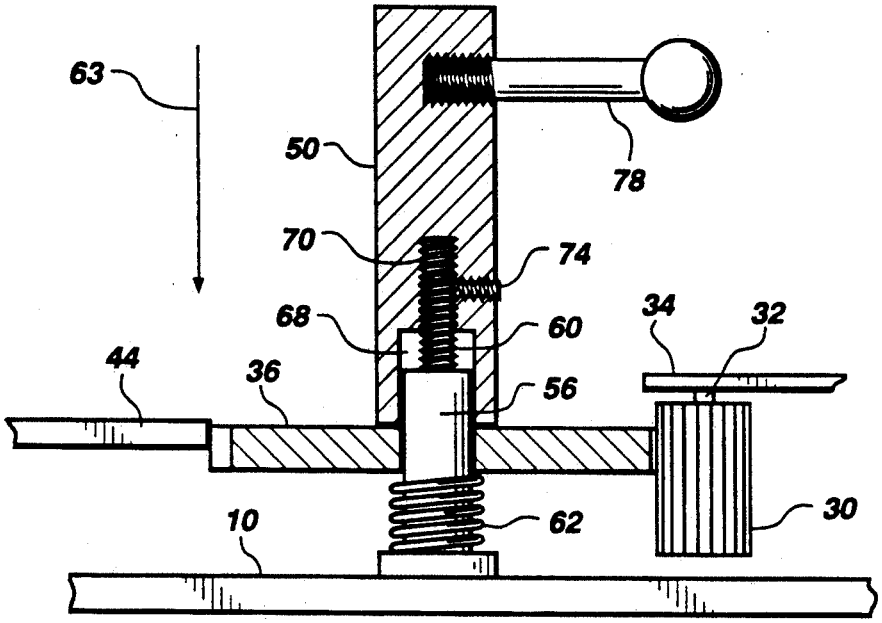
FIG. 4 is a side view of the mounting of the second gear, with the second gear being positioned in a first condition.
Figure 5:
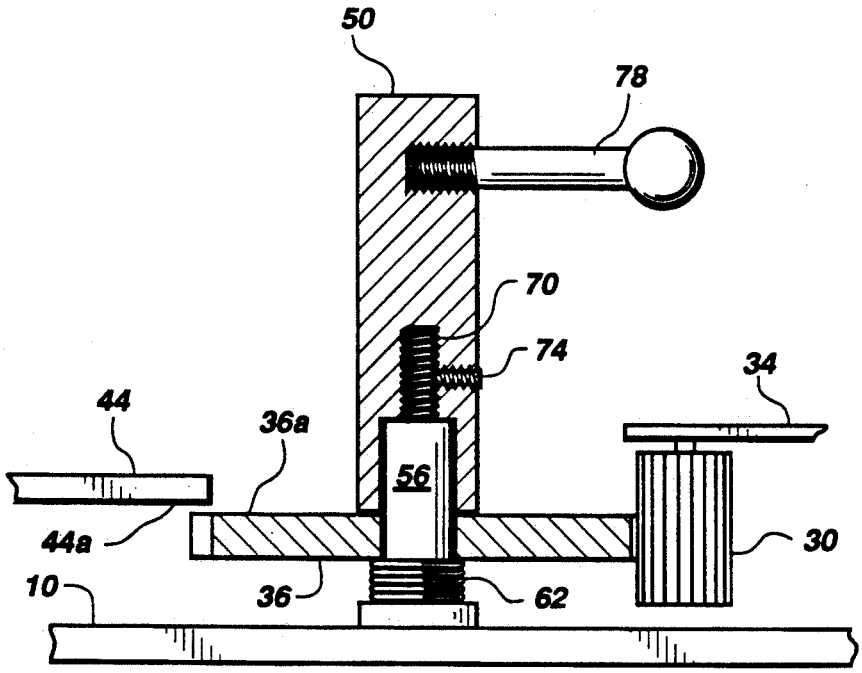
FIG. 5 is a side view of the mounting shown in FIG. 4 with the second gear being shown in a second condition.
Figure 7:
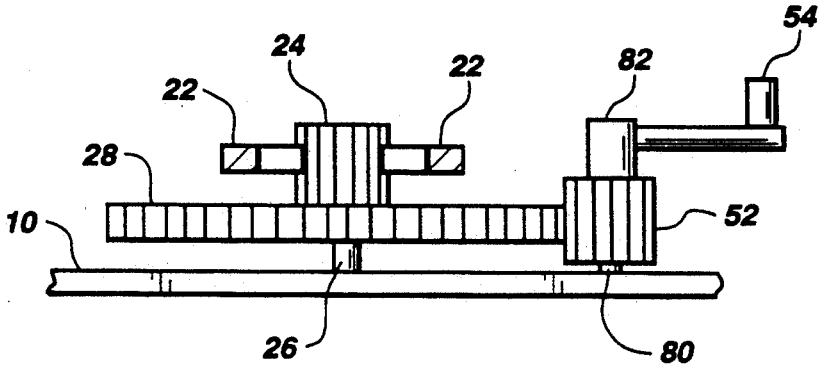
FIG. 7 is a side elevational view of the first gear shown in mechanical engagement with the driver gear.
Figure 6:
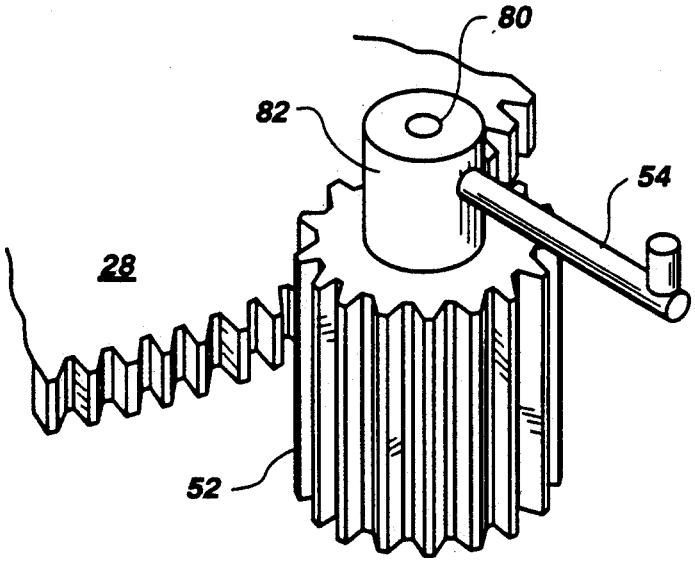
FIG. 6 is an elevated, perspective view shown in partial section of the driver gear of the locking mechanism.

Positioned atop the gear 36 is a cylindrical shaft 50. The shaft 50 defines a cylindrical channel 68 in a first end thereof. The diameter of channel 68 is dimensioned sufficiently large that the channel 68 can slidably receive the idler shaft 56. It follows that shaft 50 is rotatable about the axle formed by idler shaft 56. Communicating with the channel 68 is a female threaded channel 70 which is dimensioned to threadedly receive the male threaded portion of bolt 60. Both channel 68 and channel 70 are cylindrical in configuration. Each of these channels has a longitudinal axis which is collinear with the longitudinal axis of the shaft 50. A female threaded channel 72 is defined in the shaft 50. The channel 72 communicates with the channel 70. The longitudinal axis of the channel 72 is oriented orthogonally to the longitudinal axis of channel 70. A male threaded set screw 74 is threadedly inserted into channel 70 sufficiently to abut against the threaded portion of bolt 60 as shown in FIGS. 4 and 5. The set screw 74 operates to retain the bolt 60 in place relative to the shaft 50.

The shaft 50 also defines another female threaded channel 76. This channel is likewise cylindrical in configuration and is positioned such that its longitudinal axis is oriented orthogonal to the longitudinal axis of the shaft 50. The channel 76 is dimensioned to threadedly receive the male threaded portion of a handle 78. The securement of the handle 78 into the channel 76 is shown in FIGS. 4 and 5.

The circumference of the gear 36 is generally circular (recognizing that the gear has teeth about its perimeter). The circumference of the gear 36 defines two slot like configurations. The first slot 38 defines a generally rectangularly shaped opening in the gear. The slot 38 is dimensioned to slidably receive the latch or bolt 44 of a lock 42. The lock 42 may be of any conventional construction e.g. a key operated or combination type. The lock 42 extends through the security door 9 and includes structure 43 which is accessible from the exterior face 29 of the door 9. In its unlocked condition the latch 44 is withdrawn into the body of the lock 42. When the lock is actuated into its locked condition the latch 44 is extended outwardly from the lock assembly 42 into the orientation shown in FIG. 1.

A secondary lock is also shown in FIG. 1. This secondary lock includes a cylindrical shaft 46 which is slidably journaled and supported in a pair of guide brackets 48. The brackets are spaced from one another and provide a means to guide the shaft 46 in a path of travel along the directions illustrated by arrow 55. A coil spring 47 is positioned about the exterior of the shaft 46. The spring abuts against one of the guide brackets 48 on its first end and against a pin 49 on its second end. The spring 47 is in compression. The pin 49 is fixedly secured to the shaft 46 on one of its ends and is releaseably secured to a cover plate 51 on its second end. The cover plate is secured over both the lock 42 and the supplementary lock . The second slot like 40 opening in the gear 36 is dimensioned to slidably receive the shaft 46. The supplementary lock is adapted to operate in the event that efforts are made to violate the first lock 42. If for example, force was applied to the first lock 42 from outside the vault, e.g. by applying force to structure 43 and assuming that the force applied was of a sufficient magnitude, the lock 42 would be forced away from the interior face 10 of the security door. As the lock was forced away from the surface 10, the cover plate 51 would likewise be forced away from the surface 10. As the cover plate 51 is displaced, the securement of the pin 49 to the cover plate 51 is broken. Accordingly, the spring 47 acts against the pin 49 and displaces that pin with its attendant shaft 46 toward the gear 36 and more specifically toward the slot 40.

The shaft 46 is dimensioned such that the shaft extends well into the slot 40 to form a securement of the gear 36. Since the guide brackets 48 are mounted on the interior surface 10 of the security door the shaft 46 retained within the brackets 48 holds the gear 36 in a locked condition. The lock 42 and supplemental lock are constructed and operate similarly to the locks 122 and 130 illustrated in U.S. Pat. No. 4,679,415. The contents of the text of that patent particularly the disclosure at column 6,lines 3–68 and column 7, lines 1–14 are incorporated herein by reference.

FIGS. 4 and 5 illustrate the interrelationship of the gear 36 and the latch 44. FIG. 4 illustrates the engagement of the latch 44 with the gear 36 as further illustrated in FIG. 1. Due to the displaceable mounting of the gear 36 on the idler shaft 56 it is possible to exert manual pressure on the gear 36 by grasping the handle 78 and applying a force thereagainst in the direction indicated by arrow 63. Upon the application of sufficient force the gear 36 is displaced along the idler shaft in the direction of arrow 63. With the application of a sufficient force to overcome the resistance of the spring 62 it is possible to displace the gear 36 sufficiently that all engagement and contact between the gear 36 and the latch 44 is eliminated.

As shown in FIG. 5 the gear 36 no longer contacts the latch 44. It should be understood that the shaft 46 is mounted to the door at the same distance from the interior surface 10 as the latch 44. It follows that when the gear 36 is urged toward the interior surface 10 sufficiently that the gear 36 no longer contacts the latch 44 that the same condition would also apply to the shaft 46, i.e. the gear 36 would likewise not contact the shaft 46 with the gear 36 in the position shown in FIG. 5.

With the gear 36 is its depressed orientation it may be possible to rotate the gear 36 about its axis of rotation by means of the handle 78. By rotating the handle 78 about the axis 79 a corresponding rotation of the gear 36 can be achieved. After a sufficient angular rotation of the gear 36 sufficient that the slot 38 is no longer in register with the latch 44 the user may release the force on the handle 78 in the direction of arrow 63. Upon the release of this force the top surface **36*a* of the gear 36 would be brought into abutment against the bottom surface 44*a* of the latch 44. In this condition the gear 36 can continue to rotate about its axis of rotation not withstanding the positioning of the latch 44** in its extended, locked condition.

A toothed drive gear 52 is journaled on an axle 80 which is secured to the interior face 10 of the security door. The teeth of the gear 52 are meshed with the teeth of gear 28. A handle assembly 82 is fixedly secured to the gear 52 and is likewise journaled on the axle 80. The handle assembly 82 includes an outwardly extending shaft member 54 which is adapted to be grasped by the user. The handle assembly can be utilized to rotate the gear 52 about its axis of rotation. As the gear 52 rotates it causes a corresponding rotation of gear 28. This in turn causes a corresponding displacement of the studs 14 due to the interaction of the pinion gear 24 and the rack gears 22.

Operationally, the user operates the locking mechanism of the security door by grasping the handle 27 and turning that handle either clockwise or counterclockwise. This in turn results in the rotation of the gears 24 and 28. As the gear 24 rotates it engages the two rack gears 22 and depending on the direction of rotation of the gear 24, the rack gears are displaced either urging the studs 14 into engagement with the door frame 12 or out of engagement with that frame. As gear 28 rotates it translates its motion to gear 32 which gear then translates its motion to gear 36. Assuming that the latch 44 is in its retracted position the gear 36 simply rotates without obstruction. Upon the user having displaced the studs 14 into their outermost orientation, as shown in FIG. 1, the user then actuates the lock 42 according to the particular method of that lock by manipulating structure 43. This actuation results in the latch 44 being inserted into its respective slot 38 in gear 36 as shown in FIG. 1. The latch 44 locks the gear 36 in place and precludes its further rotation. Since the gear 36 is meshed with gear 30 and gear 30 in turn is meshed with gear 28 when gear 36 is locked in position gear 28 is also locked in position in that gear 28 can not rotate without rotating gear 36 and vice versa. If the user is located on the exterior of the vault and he wishes to open the locked door 9 he simply operates the lock structure 43 to effect a retraction of the latch 44 back into the lock 42. Thereafter he can rotate the handle 29 in order to rotate gear 28 as previously described.

Assuming that the user for some reason is located in the interior of the safe and the safe door has been inadvertently closed and locked, the user then simply pushes on the handle 78 in the direction of arrow 63 resulting in the gear 36 being urged toward the surface 10 and out of engagement with the latch 44. Once the gear 36 has cleared the latch 44, the user continues to retain the gear 36 out of contact with the latch 44 while he rotates the gear 36 using either the shaft 50/handle 78 assembly or the driver gear 52/ handle 54 assembly. The gear 36 is rotated sufficiently that the slot 38 is no longer in registration with the latch 44. Having accomplished this the user then grasps the handle 54 and by rotating that handle he causes the gear 28 to be rotated clockwise about its axis of rotation. As he continues to rotate the gear 52 the studs 14 are withdrawn from their locking engagement with the door frame. Having reached this juncture the user simply pushes on the interior surface of the door 10 to cause the door to swing open.

As noted in the drawing figures , it is contemplated that the number of teeth on the various gears be selected to achieve optimum operability of the mechanism. It is contemplated that gears 28 and 36 be eighty tooth gears while gears 24, 32 and 52 be fifteen tooth gears.

The instant description is intended to be merely illustrative of the principles of the invention and not intended to limit the scope of the claims which are appended hereto.

I claim:

1. A locking mechanism for use with a lightweight security door, said locking mechanism comprising:

a first gear rotatably mounted on an interior surface of said lightweight security door;

actuation means mounted on said lightweight security door, for rotating said first gear from a location proximate said exterior surface of said lightweight security door;

first locking means mounted on said lightweight security door and mechanically associated with said first gear for locking said lightweight security door within a door frame, said first locking means being actuated by a rotation of said first gear;

a second gear rotatably mounted on said interior surface of said lightweight security door, said second gear being mechanically associated with said first gear, a rotation of said second gear effecting a corresponding rotation of said first gear;

a second locking means for engaging and locking said second gear in place, a locking of said second gear effecting a corresponding locking of said first gear;

a release means associated with said second gear for displacing said second gear out of contact with said second locking means thereby freeing said second gear for rotation about its respective axis of rotation.

2. The locking mechanism of claim 1 wherein said release means is adapted to displace said second gear along a path oriented orthogonal to a plane of said interior surface of said lightweight security door.

3. The locking mechanism of claim 1 further including a resistance means associated with said second gear, said resistance means being adapted to urge said second gear into engagement with said second locking means.

4. The locking mechanism of claim 3 wherein said resistance means is a spring.

5. The locking mechanism of claim 1 further including a driver gear means mechanically associated with said first gear for rotating said first gear upon said second gear being displaced out of engagement with said second locking means.

6. The locking mechanism of claim 1 wherein said second gear defines at least one slot therein and said second locking means includes an outwardly extending latch adapted to be received within said slot and thereby retain said second gear in a locked condition.

7. A locking mechanism for use with a lightweight security door, said locking mechanism comprising:

a first gear rotatably mounted on an interior surface of said lightweight security door;

a second gear rotatably mounted on said interior surface, said second gear being mechanically associated with said first gear wherein a rotation of one said gear causes a corresponding rotation of the other said gear;

a pair of rack gear fitted shafts slidably mounted on said interior surface, said pair of rack gear fitted shafts being mechanically associated with said first gear wherein a rotation of said first gear causes said pair of rack gear fitted shafts to be displaced along said interior surface;

a plurality of studs, said studs being adapted to each of said shafts, said studs being adapted to engage and form a releasable locking engagement with a door frame associated with said lightweight security door;

a lock mounted on said interior surface, said lock being adapted to engage said second gear and form a releasable locking engagement therewith;

said second gear being manually displaceably mounted on said interior surface wherein a displacement of said second gear disengages said second gear from said lock thereby permitting a rotation of said second gear.

8. The locking mechanism of claim 7 wherein said second gear is displaceable along a linear path orthogonal to the plane of said interior surface.

9. The locking mechanism of claim 7 wherein said second gear defines a slot therein configured to receive a latch of said lock and form a locking engagement therewith.

10. The locking mechanism of claim 7 further including a third gear rotatably mounted on said interior surface and mechanically intercooperated with said first gear, said third gear being fitted with a handle for facilitating a manual rotation of said third gear from a location proximate said interior surface, a rotation of said third gear effecting a corresponding rotation of said first gear, said third gear being adapted to facilitate a manually induced rotation of said first gear subsequent to a displacement of said second gear and a disengagement of said second gear from said lock.

* * * * *